US006986704B1

(12) United States Patent
Liao

(10) Patent No.: US 6,986,704 B1
(45) Date of Patent: Jan. 17, 2006

(54) SAND BELT-TENSIONING DEVICE

(76) Inventor: Juei-Seng Liao, No. 396, Yung-Ming St., Ta-Li City, Taichung Hsien (TW)

( * ) Notice: Subject to any disclaimer, the term of this patent is extended or adjusted under 35 U.S.C. 154(b) by 0 days.

(21) Appl. No.: 10/970,162

(22) Filed: Oct. 21, 2004

(30) Foreign Application Priority Data

Aug. 2, 2004 (TW) ..... 93212220 U

(51) Int. Cl.
*B24B 45/00* (2006.01)

(52) U.S. Cl. ..... 451/500; 474/112

(58) Field of Classification Search ..... 451/504, 451/500, 499, 490; 474/101, 111, 112, 115, 474/117
See application file for complete search history.

(56) References Cited

U.S. PATENT DOCUMENTS 3,818,651 A * 6/1974 Eelis ..... 451/500
5,062,363 A * 11/1991 Reichel ..... 101/415.1
5,713,808 A * 2/1998 Ohta ..... 474/94
5,842,913 A * 12/1998 Nemazi ..... 451/499
2001/0007813 A1 * 7/2001 Cadrobbi ..... 451/526

* cited by examiner

*Primary Examiner*—Jacob K. Ackun
(74) *Attorney, Agent, or Firm*—Ostrolenk, Faber, Gerb & Soffen, LLP

(57) ABSTRACT

A sand belt-tensioning device includes a drive roller, a fixing member, a pulling member, and a resilient member. A sand belt is wound around a roller body of the drive roller. The drive roller has opposite first and second end surfaces that are formed respectively with axially extending first and second rotating shafts. The fixing member is sleeved fixedly on the first rotating shaft, and is connected fixedly to an end of the sand belt. The pulling member is sleeved rotatably on the second rotating shaft, and is connected fixedly to the other end of the sand belt at an eccentric position. The resilient member biases the pulling member to rotate about the second rotating shaft in a direction so as to tauten the sand belt on the drive roller.

1 Claim, 5 Drawing Sheets

SAND BELT-TENSIONING DEVICE

CROSS-REFERENCE TO RELATED APPLICATION

This application claims priority of Taiwanese Application No. 093212220, filed on Aug. 2, 2004.

BACKGROUND OF THE INVENTION

1. Field of the Invention

This invention relates to a tensioning device, and more particularly to a sand belt-tensioning device that includes a drive roller and a resilient member for tautening a sand belt on the drive roller.

2. Description of the Related Art

Referring to FIG. 1, a conventional grinding device is shown to include a drive roller 1 and a sand belt 2 wound around the drive roller 1. The drive roller 1 has a roller body 11, and two opposite end surfaces that are formed respectively and integrally with two aligned rotating shafts 12. Two fixing members 13 are sleeved respectively and fixedly on the first and second rotating shafts 12, abut respectively against the end surfaces of the drive roller 1, and are connected respectively and fixedly to two opposite ends of the sand belt 2.

Referring to FIG. 2, during use of the conventional grinding device, the roller 1 is rotated, and a wooden workpiece 3 is pressed against a bottom side of the roller 1. The wooden workpiece 3 is also moved in a horizontal direction in such a manner that frictional contact therebetween is maintained. Therefore, a top surface of the wooden workpiece 3 is finished. During movement of the wooden workpiece 3 under the grinding device, a portion 23 of the sand belt 2 is pushed by the wooden workpiece 3 to move away from an outer surface of the roller 1. This results in unsmooth movement of the wooden workpiece 3 and a dissatisfactory grinding effect.

SUMMARY OF THE INVENTION

The object of this invention is to provide a sand belt-tensioning device that includes a drive roller and a resilient member for tautening a sand belt on the drive roller.

According to this invention, a sand belt-tensioning device includes a drive roller, a fixing member, a pulling member, and a resilient member. A sand belt is wound around a roller body of the drive roller. The drive roller has opposite first and second end surfaces that are formed respectively with axially extending first and second rotating shafts. The fixing member is sleeved fixedly on the first rotating shaft, and is connected fixedly to an end of the sand belt. The pulling member is sleeved rotatably on the second rotating shaft, and is connected fixedly to the other end of the sand belt at an eccentric position. The resilient member biases the pulling member to rotate about the second rotating shaft in a direction so as to tauten the sand belt on the drive roller.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
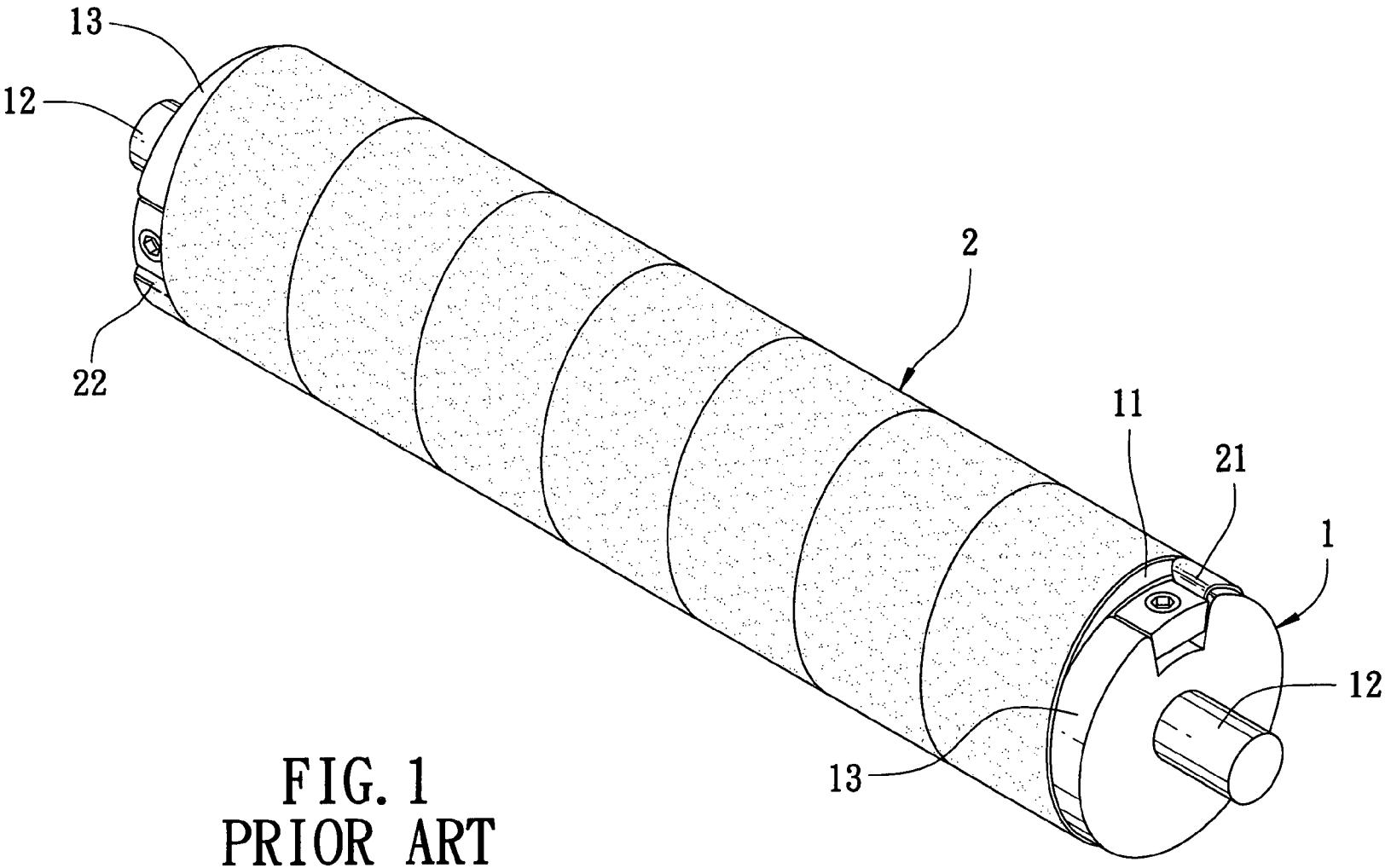
FIG. 1 PRIOR ART
FIG. 1 is a perspective view of a conventional grinding device.
Figure 2:
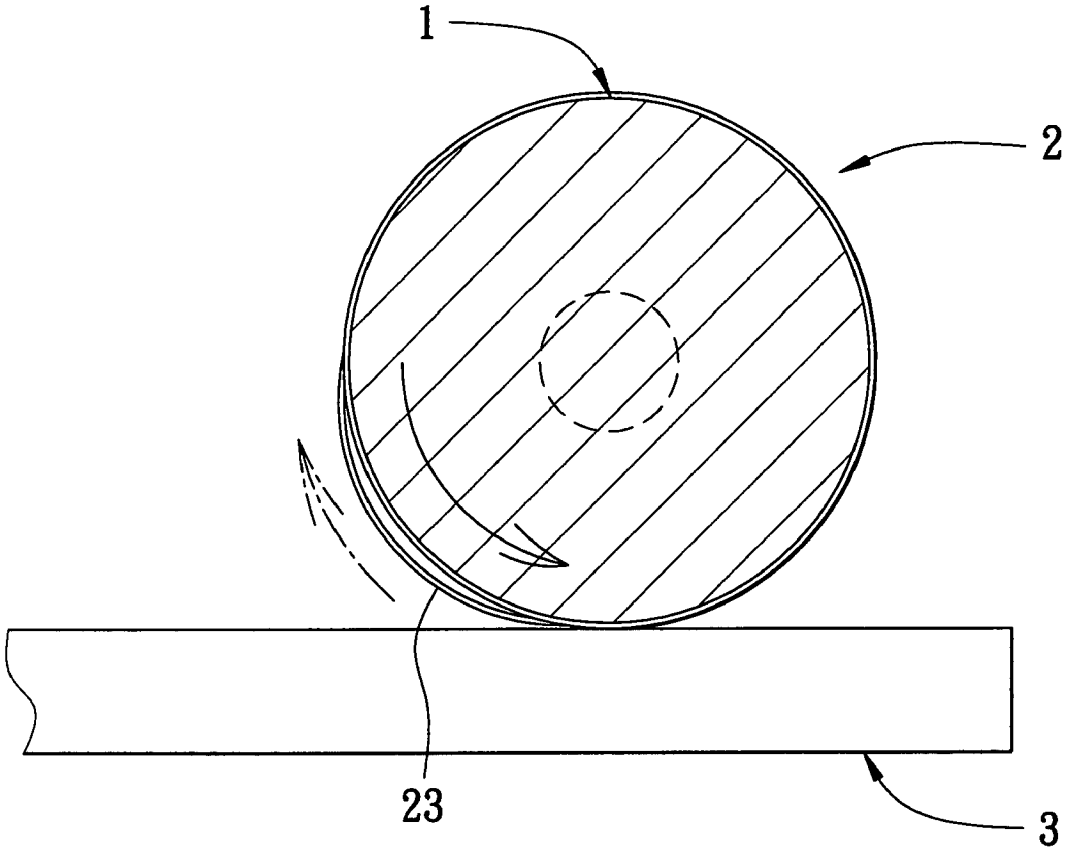
FIG. 2 PRIOR ART
FIG. 2 is a cross sectional view of the conventional grinding device, illustrating how a wooden workpiece is finished.
Figure 3:
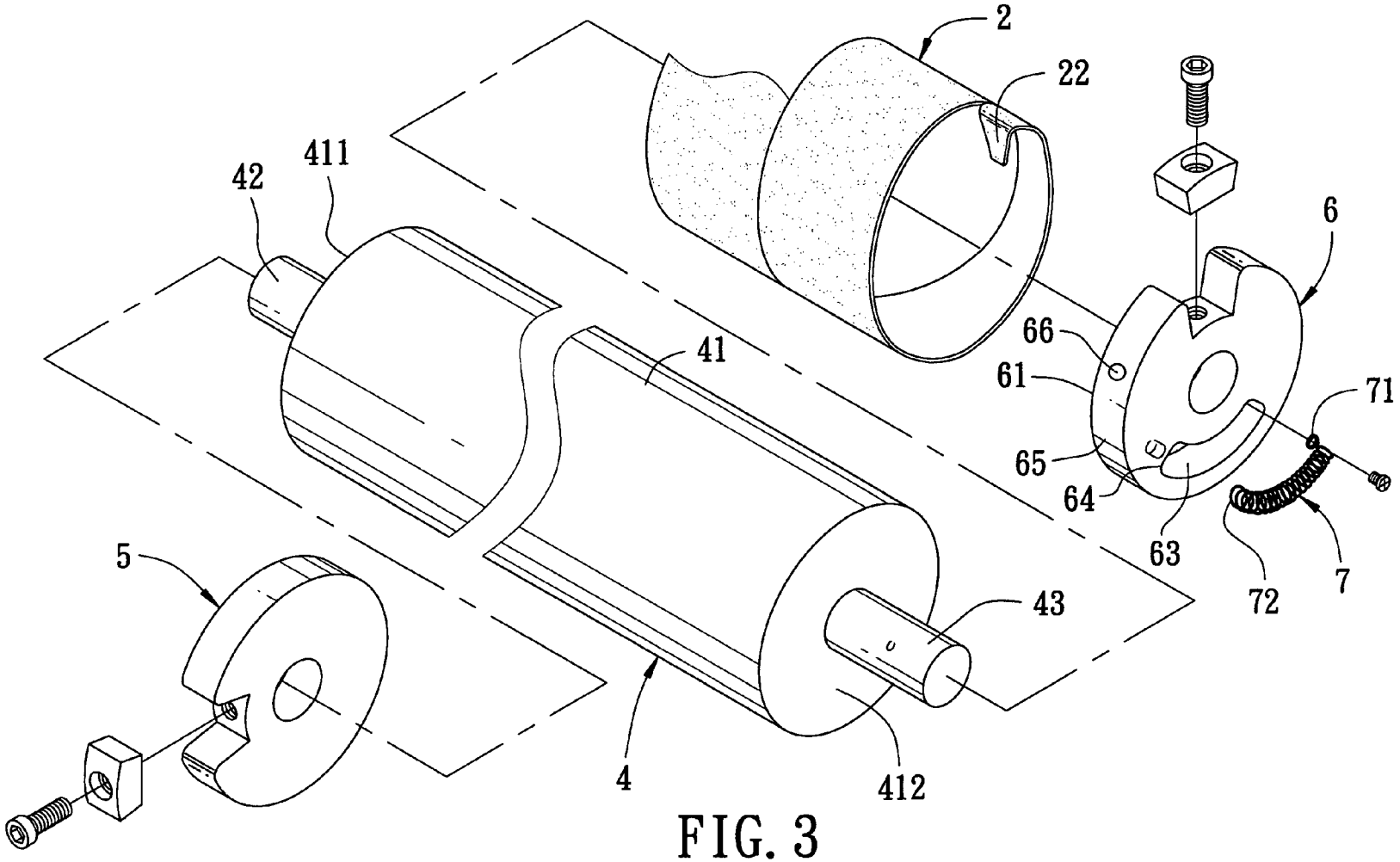
FIG. 3 is an exploded perspective view of the preferred embodiment of a sand belt-tensioning device according to this invention.
Figure 4:
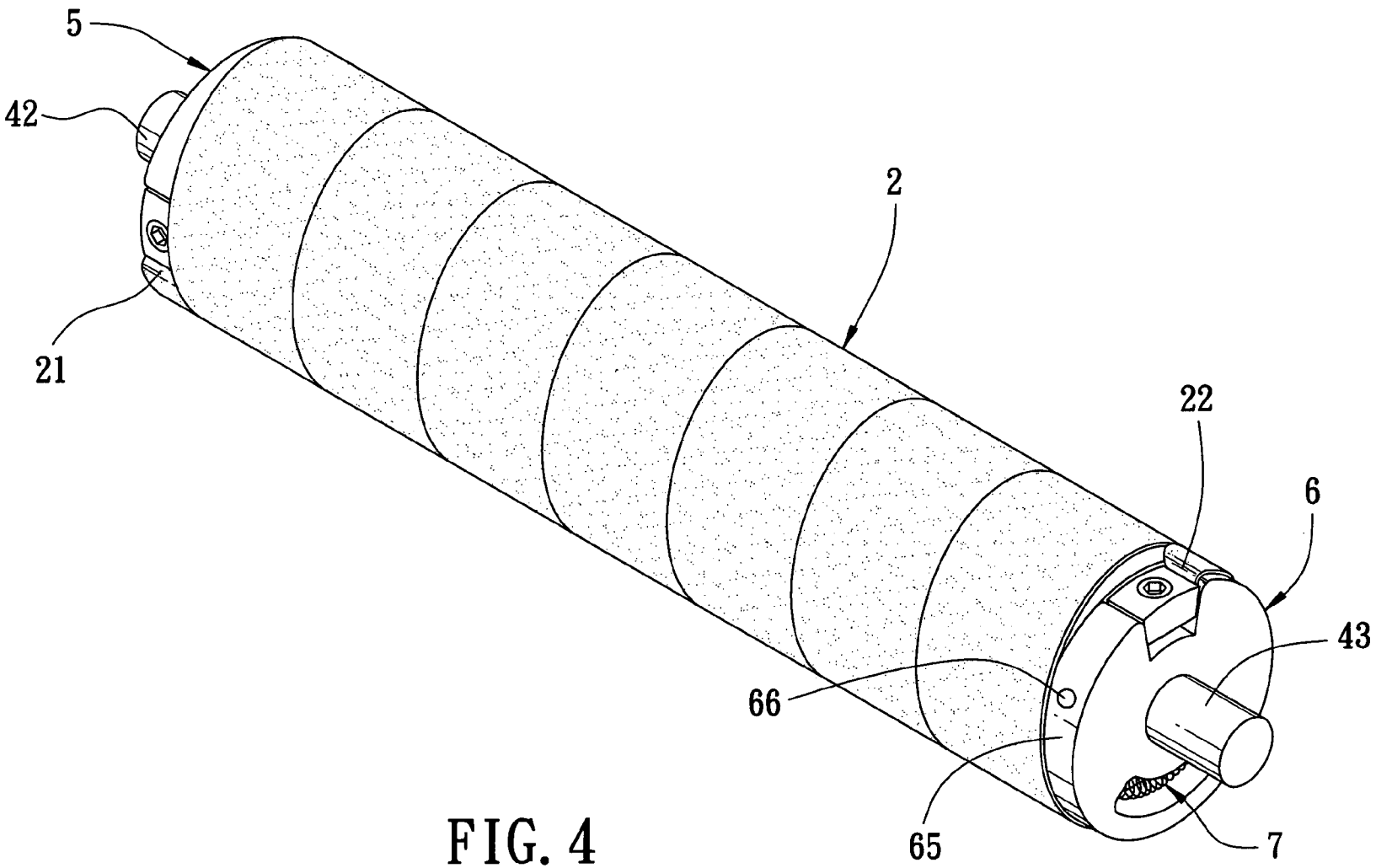
FIG. 4 is an assembled perspective view of the preferred embodiment.
Figure 5:
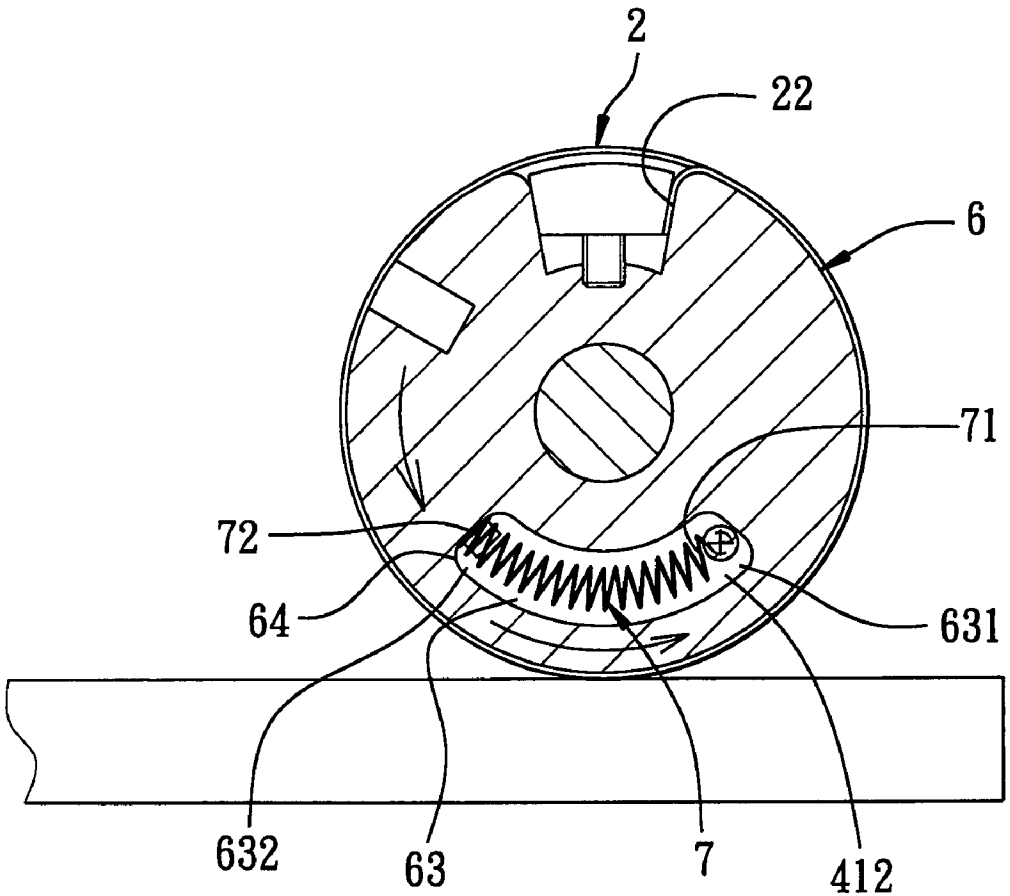
FIG. 5 is a cross-sectional view of the preferred embodiment, illustrating how a wooden workpiece is finished.

Referring to FIGS. 3, 4, and 5, the preferred embodiment of a sand belt-tensioning device according to this invention is shown to include a driven roller 4, a fixing member 5, a pulling member 6, and a resilient member 7.

The drive roller 4 includes a roller body 41 having opposite first and second end surfaces 411, 412, and aligned first and second rotating shafts 42, 43 extending respectively and axially from the first and second end surfaces 411, 412 of the roller body 41. A sand belt 2 for performing a finishing operation can be wound around the roller body 41 of the roller 4.

The fixing member 5 is sleeved fixedly on the first rotating shaft 42, and is adjacent to the first end surface 411 of the roller body 41. A first end 21 of the sand belt 2 is locked on the fixing member 5 in a known manner.

The pulling member 6 is sleeved rotatably on the second rotating shaft 43, and is adjacent to the second end surface 412 of the roller body 41. A second end 22 of the sand belt 2 is locked on the pulling member 6 at an eccentric position in a known manner. The pulling member 6 has an inner side surface 61 abutting against the second end surface 412 of the roller body 41, an outer side surface opposite to the inner side surface 61, and a slot 63 formed through the pulling member 6 and extending along a circumferential direction of the pulling member 6. The slot 63 has opposite first and second ends 631, 632.

The resilient member 7 is disposed within the slot 63 in the pulling member 6, and is configured as a coiled tension spring that has a first end 71 located at the first end 631 of the slot 63 in the pulling member 6 and fastened to the second end surface 412 of the roller body 41, and a second end 72 fastened to a wall 64 of the pulling member 6 defining the second end 632 of the slot 63 so as to bias the wall 64 in a direction toward the first end 71 of the resilient member 7. Thus, the pulling member 6 is biased to rotate in a counterclockwise direction shown by the arrows in FIG. 5 so as to tauten the sand belt 2 on the driven roller 4.

The pulling member 6 further has an annular outer surface 65 that is formed with a tool hole 66. To prepare the sand belt-tensioning device for use, the first end 21 of the sand belt 2 is locked on the fixing member 5, after which the sand belt 2 is wound around the roller body 41 of the drive roller 4. Subsequently, a tool (not shown) is inserted into the tool hole 66 in the pulling member 6, and is co-rotated with the pulling member 6 in a clockwise direction against the biasing action of the resilient member 7. After reaching a desired level of tautness, the second end 22 of the sand belt 2 is locked on the pulling member 6 in a known manner. Finally, the tool is removed from the tool hole 66. The end result is that the sand belt 2 is maintained in a tautened state on the roller 4, thereby enabling smooth movement of the wooden workpiece, which is to be finished, relative to the roller 4. The grinding of the wooden workpiece is also made more effective by such tautening of the sand belt 2 on the roller 4.

With this invention thus explained, it is apparent that numerous modifications and variations can be made without departing from the scope and spirit of this invention. It is therefore intended that this invention be limited only as indicated by the appended claims.

I claim:

1. A sand belt-tensioning device comprising:

a drive roller adapted to permit a sand belt to be wound therearound, said drive roller including a roller body having opposite first and second end surfaces, and aligned first and second rotating shafts extending respectively and axially from said first and second end surfaces of said roller body;

a fixing member sleeved fixedly on said first rotating shaft and adjacent to said first end surface of said drive roller, said fixing member being adapted to be connected fixedly to an end of the sand belt;

a pulling member sleeved rotatably on said second rotating shaft and adjacent to said second end surface of said drive roller, said pulling member being adapted to be connected fixedly to the other end of the sand belt at an eccentric position;

a resilient member for biasing said pulling member to rotate about said second rotating shaft in a direction so as to tauten the sand belt on said drive roller; and said pulling member has a slot formed therethrough and extending along a circumferential direction of said pulling member, said slot having opposite first and second ends, said resilient member being disposed within said slot in said pulling member and being configured as a coiled tension spring that has a first end located at said first end of said slot in said pulling member and fastened to said second end surface of said roller body of said drive roller, and a second end fastened to a wall of said pulling member defining said second end of said slot so as to bias the wall in a direction toward said first end of said resilient member, thereby providing a biasing force to said pulling member to rotate about said second rotating shaft in the direction.

* * * * *